US010072463B2

(12) United States Patent
Rao et al.

(10) Patent No.: US 10,072,463 B2
(45) Date of Patent: Sep. 11, 2018

(54) ANTI-BALLING DRILL BIT POSITIONED RELATIVE TO FIXED BLADES PRESENTING FIXED CUTTING INSERTS

(71) Applicants: Yan Yan Rao, Chengdu (CN); Xiao Jun Peng, Chengdu (CN)

(72) Inventors: Yan Yan Rao, Chengdu (CN); Xiao Jun Peng, Chengdu (CN)

( * ) Notice: Subject to any disclaimer, the term of this patent is extended or adjusted under 35 U.S.C. 154(b) by 172 days.

(21) Appl. No.: 14/534,013

(22) Filed: Nov. 5, 2014

(65) Prior Publication Data

US 2016/0123086 A1 May 5, 2016

(51) Int. Cl.
*E21B 10/42* (2006.01)
*E21B 10/55* (2006.01)

(52) U.S. Cl.
CPC ..... *E21B 10/42* (2013.01)

(58) Field of Classification Search
CPC ..... E21B 10/46
See application file for complete search history.

(56) References Cited

U.S. PATENT DOCUMENTS

| | | | | |
|---|---|---|---|---|
| 3,301,339 | A * | 1/1967 | Pennebaker, Jr. | E21B 10/04 175/387 |
| 5,562,171 | A * | 10/1996 | Besson | E21B 10/18 175/339 |
| 5,655,614 | A * | 8/1997 | Azar | E21B 10/04 175/404 |
| 8,950,517 | B2 * | 2/2015 | Hall | E21B 4/14 175/385 |
| 8,960,335 | B2 * | 2/2015 | Hahati | E21B 10/485 175/404 |
| 9,347,275 | B2 * | 5/2016 | Azar | E21B 10/485 |
| 2012/0152624 | A1 * | 6/2012 | Chen | E21B 10/43 175/428 |

* cited by examiner

*Primary Examiner* — David J Bagnell
*Assistant Examiner* — Brandon M Duck
(74) *Attorney, Agent, or Firm* — Patrick Reilly

(57) ABSTRACT

The disclosure relates to polycrystalline diamond compact (PDC) drill bits utilized for drilling wellbores.

4 Claims, 11 Drawing Sheets

ANTI-BALLING DRILL BIT POSITIONED RELATIVE TO FIXED BLADES PRESENTING FIXED CUTTING INSERTS

BACKGROUND OF THE INVENTION

Field of the Invention

The invention concerns polycrystalline diamond compact ("PDC") drill bits used in drilling well bores.

Description of the Prior Art

PDC drill bits are commonly used to drill wellbores in the hydrocarbon industry. These bits can provide efficient drilling speeds and effective cutting. Further, it is possible to recondition worn bits through maintenance such as replacing worn cutting elements.

However, the design of these bits leads to a phenomenon known as "balling." In general, a PDC drill bit comprises a plurality of stationary (relative to the bit body) blades, into which the cutting elements are mounted. These blades extend outwardly from the bit body, and extend below the bit body before curving generally inward toward the longitudinal axis of the bit.

"Below the bit body" in this context, will be understood to mean "further downhole from the surface than the bit body," because utilization in directional drilling may place the tool in an effectively horizontal position.

Between the blades are "junk slots" that allow mud and other debris to pass uphole through the drilling fluid flow past the bit. However, the common design of PDC bits creates a cavity, or cone, between the curved-in blades of the tool and the body of the tool. Because the linear speed of the tool decreases as the distance from the longitudinal axis of the tool decreases, mud and other debris that accumulate in the cone are not as readily thrown into the outward flow through the junk slots.

Accordingly, mud and other debris can accumulate in the cone. When such an accumulation occurs, it tends to stick to more debris, creating a "balling" effect. As the ball grows outward, it can impede the cutters on the bit, reducing, and potentially eliminating, drill efficiency.

Attempts to prevent balling have included such efforts as U.S. Pat. No. 7,694,755 to Marvel, et al. which suggests varying the depth of at least one junk slot from that of the other junk slots, presumably in an attempt to provide a flow path to debris closer to the longitudinal axis of the tool. However, such variations must be carefully balanced to prevent rotational imbalance of the tool, and may slow, but not necessarily prevent, the balling phenomenon.

Other attempts to prevent downhole balling in drill bits include the use of emulsifiers or lubricants, as with U.S. Pat. No. 5,586,608 to Clark, et al., and U.S. Pat. Nos. 5,007,489 and 5,099,930, both to Enright et al.

However, despite prior art attempts, the problem of drill bit balling remains. Accordingly, it is desirable to provide a PDC drill bit that can prevent or greatly reduce the effect of balling.

SUMMARY OF THE INVENTION

The invention comprises a PDC drill bit with an added projection in the cone portion of the bit. The lobe provides protection against balling during drilling. The projection forces particulate material outward from the center area of the cone into the higher-rate flow zones so that circulating drilling fluid will remove it.

The projection may comprise a lobe, a spherical or hemispherical shape, a tapered shape, or any other shape which serves to push or force particulate material outward from the longitudinal centerline of the tool.

DETAILED DESCRIPTION OF SPECIFIC EMBODIMENTS

Figure 1:
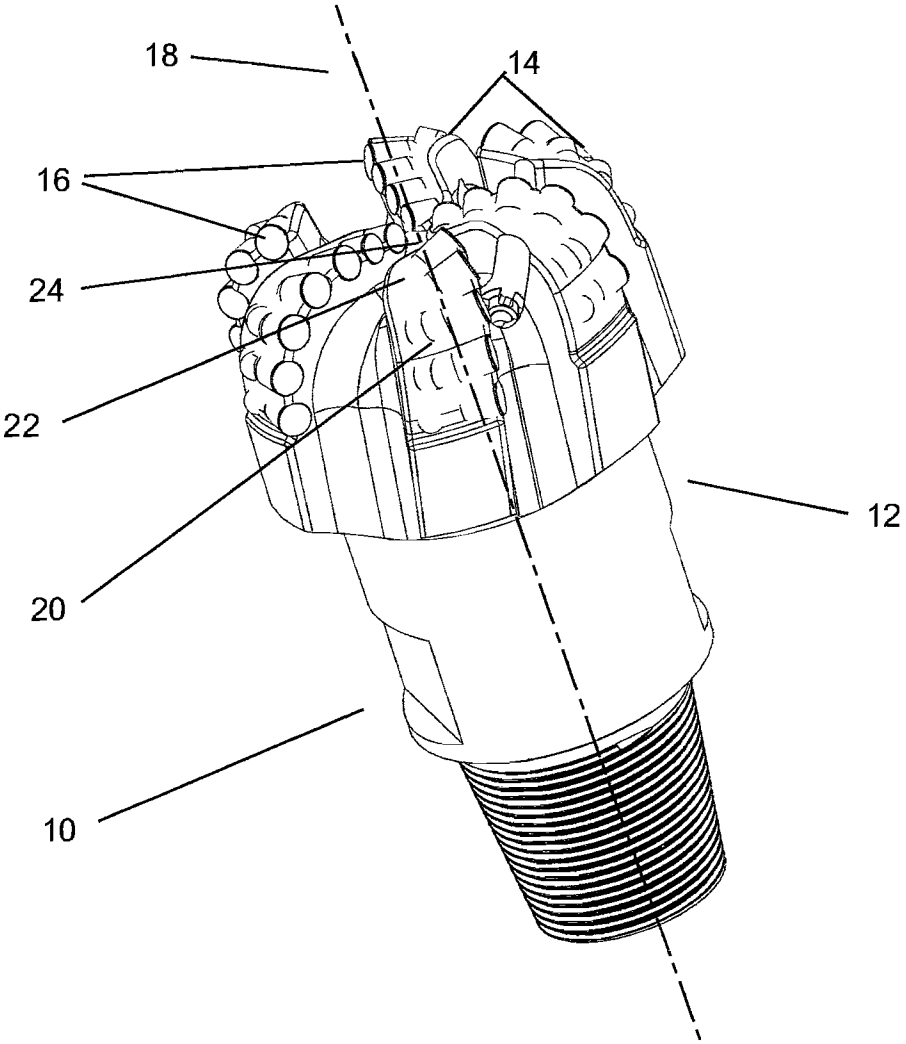
Fig. 1 (Prior Art)
FIG. 1 is an oblique top view of a prior art PDC bit.

Referring to FIG. 1, a prior art PDC drill bit is shown. The bit 10 has a body 12 and blades 14 which comprise cutters 16. Blades 14 characteristically curve inward toward the longitudinal axis 18, forming shoulders 20 and nose 22. In the central area of the ends of blades 14 is the cone 24. It is in cone 24 that particulate material (not shown) tends to accumulate, initiating the growth of a ball and hampering, or even stopping, the cutting action of the bit.

Figure 2:
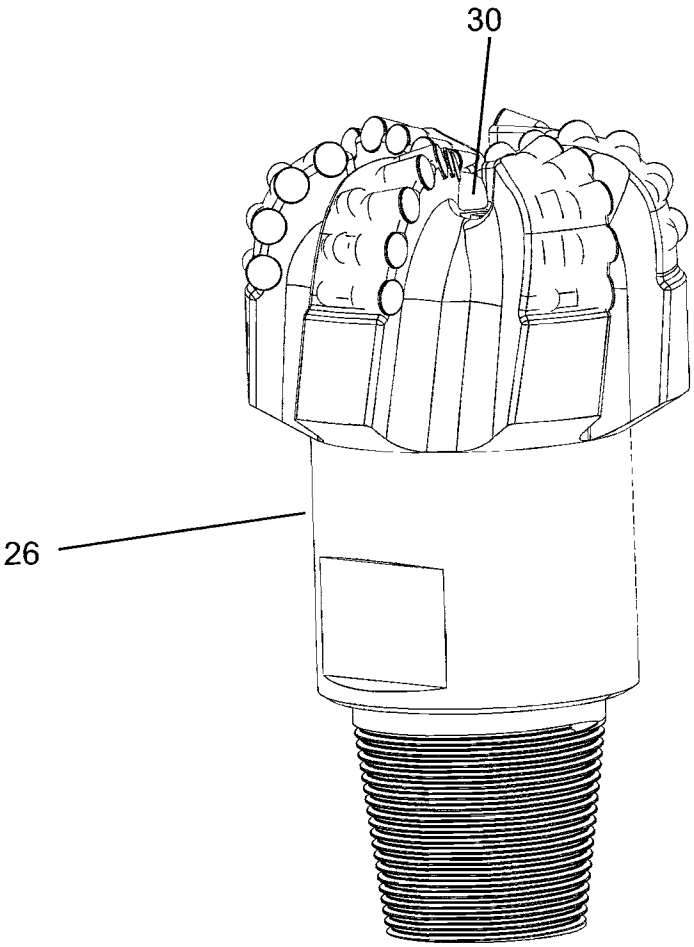
FIG. 2 is a side view of an embodiment of a PDC bit of the present invention.
Figure 2A:
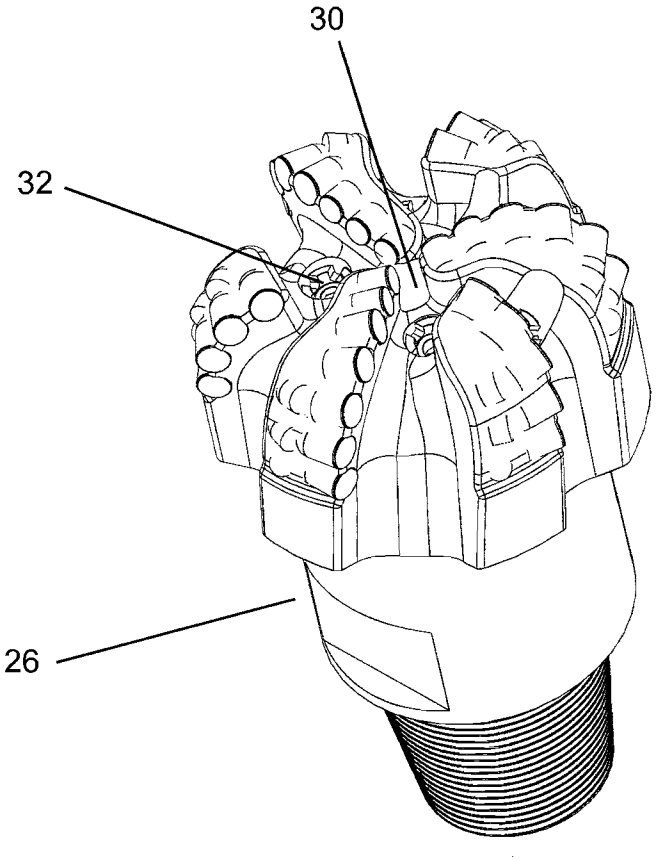
FIG. 2A is an oblique top view of the embodiment of FIG. 2.

Referring to FIGS. 2 and 2A, an embodiment of a bit of the present invention is shown. Bit 26 have parts corresponding to those of the prior art bit. (10 of FIG. 1). In addition, bit 26 comprise projecting element 30 within the cone 24 of FIG. 1. Projecting element 30 may be variously shaped. It is shown as a lobe shape, but may be made in any shape, for example, a taper, that is sufficient to push debris away from cone 24 and toward the fluid flow emanating from jets 32. Nor is it necessary that the projecting element 30 have smooth sides (although a smooth sided-projecting element is shown for illustrative purposes). Those of skill in the art will further recognize that the projecting element may be formed as part of the body 12 of the bit, or be otherwise attached thereto.

The purpose of the projecting elements is to deflect extraneous material away from that part of cone 24 in the area of the longitudinal axis 18 of the bit. Accordingly, while the shape of the projecting element may vary, it is desirable that it not have pockets or other areas in its surface where material could accumulate. Forcing material away from the part of cone 24 in the area of the longitudinal axis 18 of the bit keeps the material out of the dead zone and pushes it into the drilling fluid flow, precluding the initiation of ball formation.

Figure 2B:
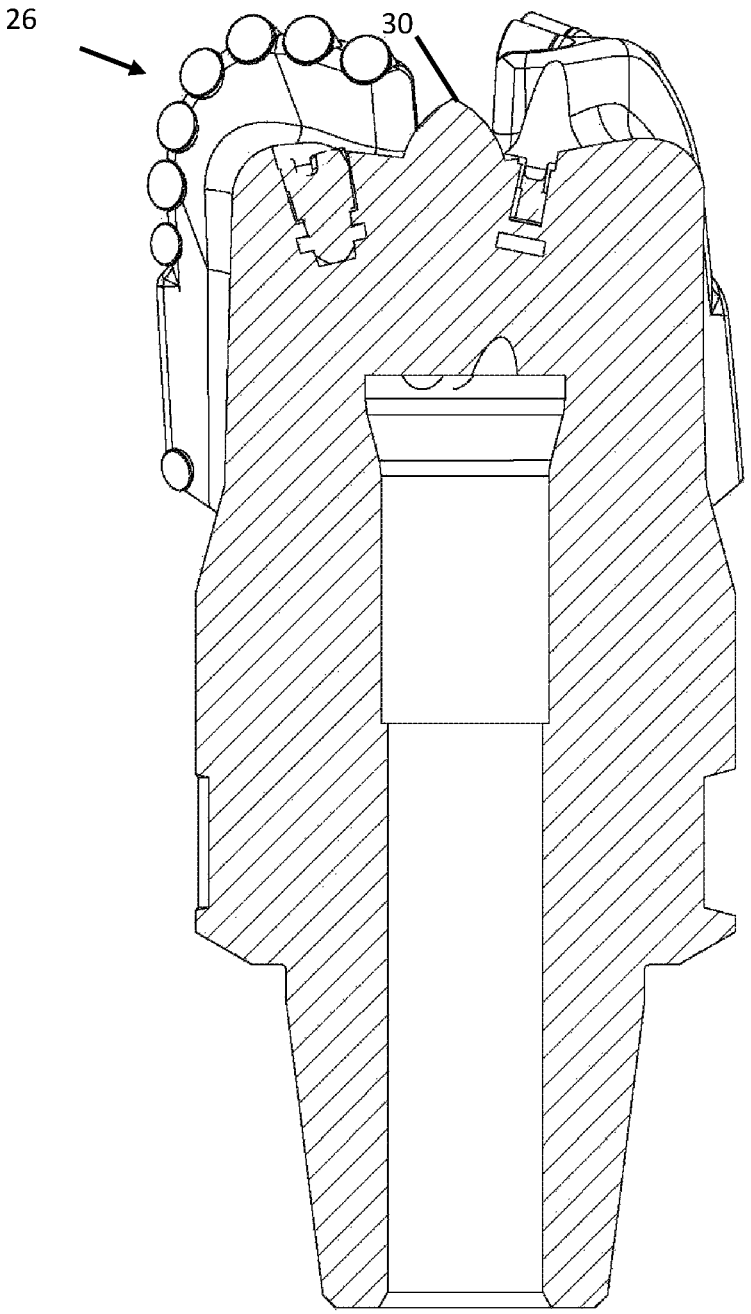
FIG. 2B is an oblique top view of the preferred embodiment of the invention of FIG. 2 and FIG. 2A.
Figure 2C:
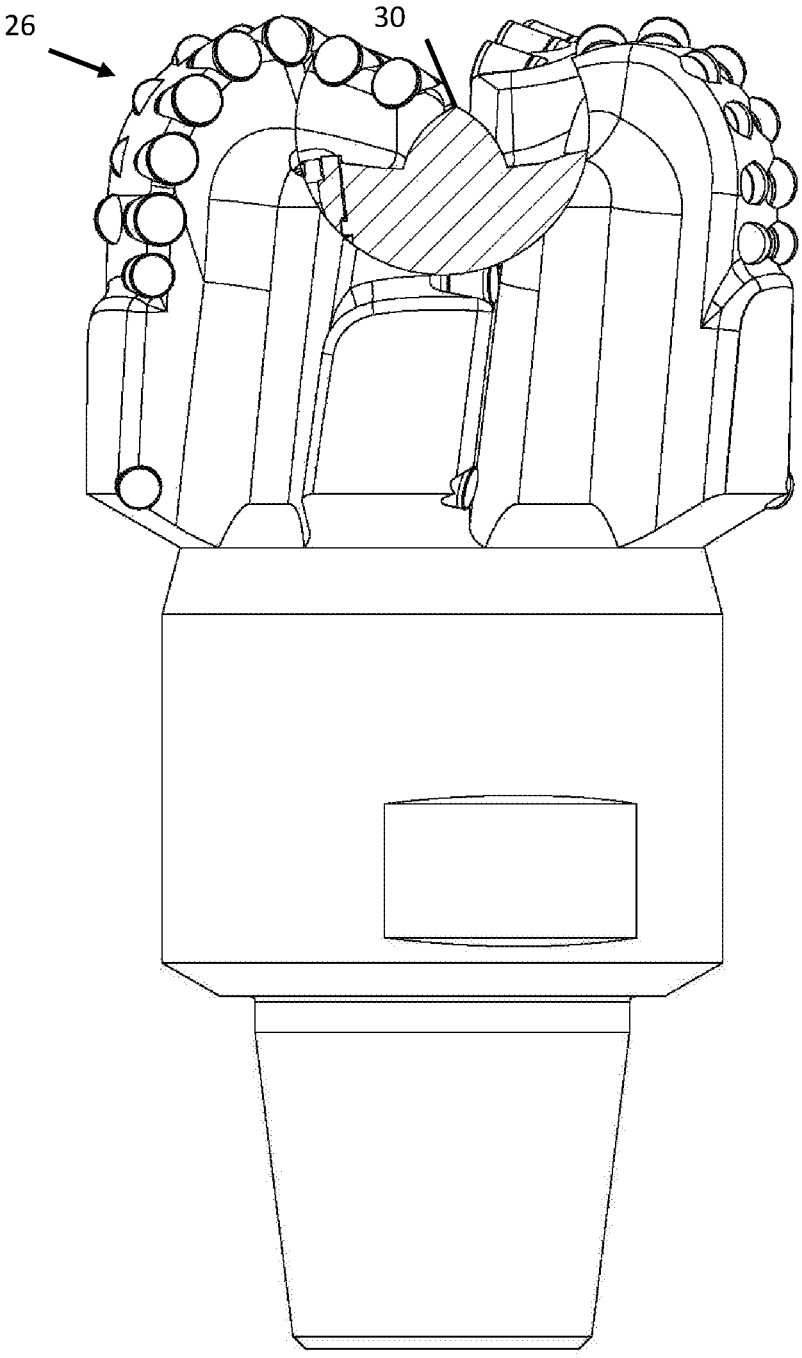
FIG. 2C is a cut-away side view of the preferred embodiment of the present invention of FIG. 2, FIG. 2A and FIG. 2B.

Referring now generally to the Figures and particularly to FIGS. 2B and 2C, FIG. 2B is an oblique top view of the bit 26. FIG. 2C is a cut-away side view of bit 26.

Figure 3A:
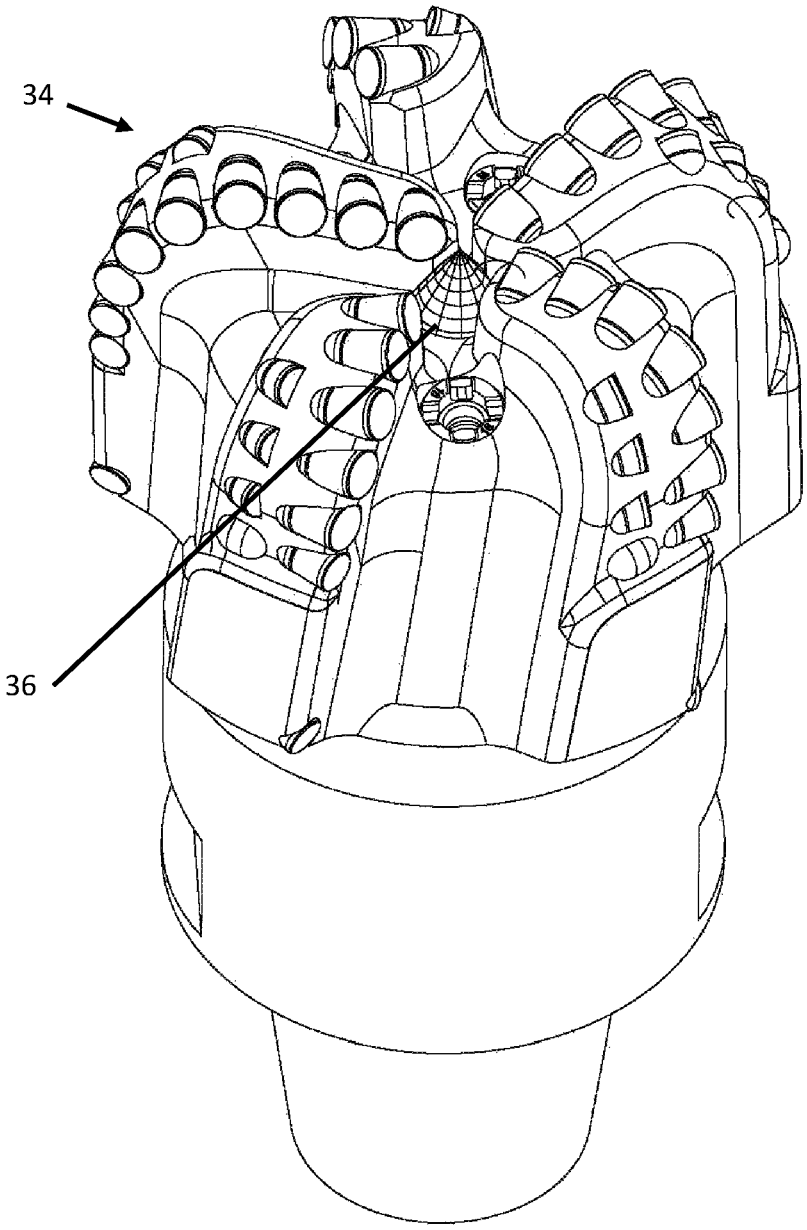
FIG. 3A is an oblique top view of a second preferred alternate embodiment of the present invention having a tapered projecting element.
Figure 3B:
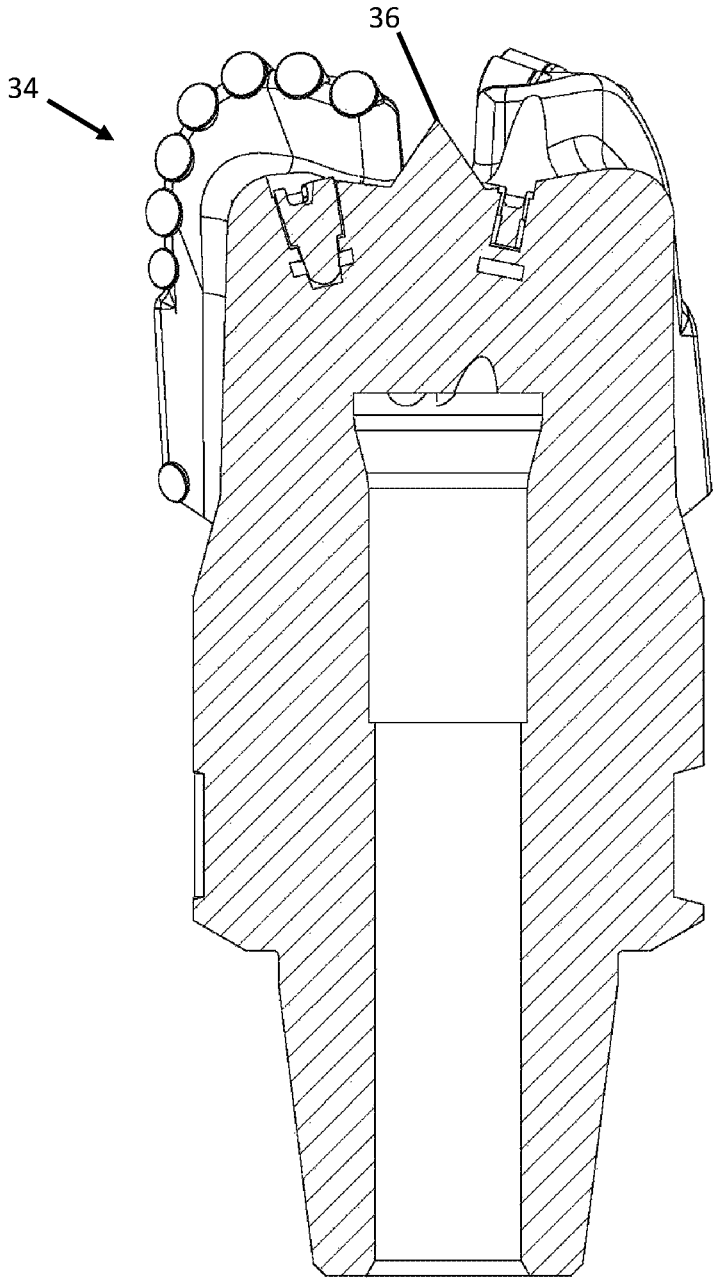
FIG. 3B is a cut-away side view of the second preferred alternate embodiment of the present invention of FIG. 3A.
Figure 3C:
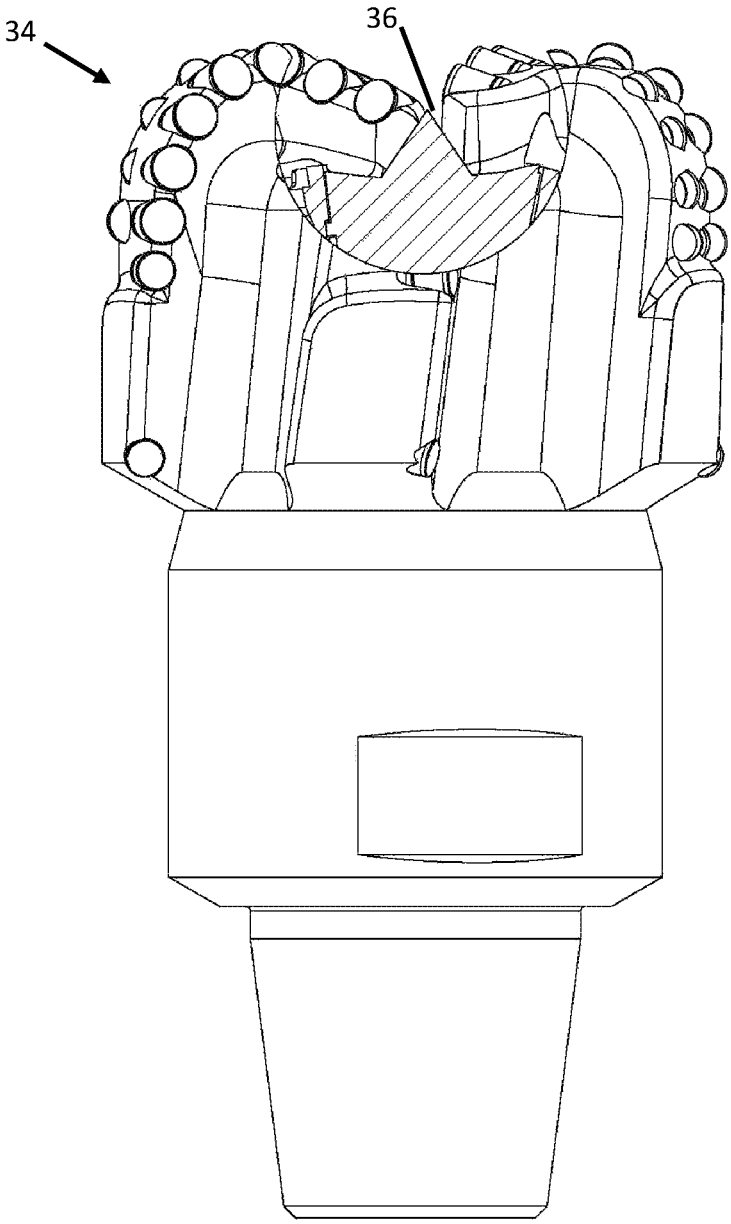
FIG. 3C is a partial detailed cut-away side view of the second preferred alternate embodiment of the present invention of FIG. 3A.

Referring now generally to the Figures and particularly to FIGS. 3A, 3B and 3C, a second preferred embodiment of the present invention 34 (hereinafter, "second invented bit" 34) is shown. The second invented bit 34 has elements 12-22 corresponding to those of the prior art bit 10. In addition, the second invented bit 34 comprises a tapered projecting element 36 positioned within the cone 24 of FIG. 1. The tapered projecting element 36 is shaped and sized and positioned to push debris away from cone 24 and toward the fluid flow emanating from jets 32. It not necessary that the tapered projecting element 36 have smooth sides, although a smooth sided tapered projecting element 36 is shown for illustrative purposes. Those of skill in the art will further recognize that the tapered projecting element 36 may be integrally formed as part of the body 12 of the second invented bit 34, or be otherwise attached thereto.

Figure 4A:
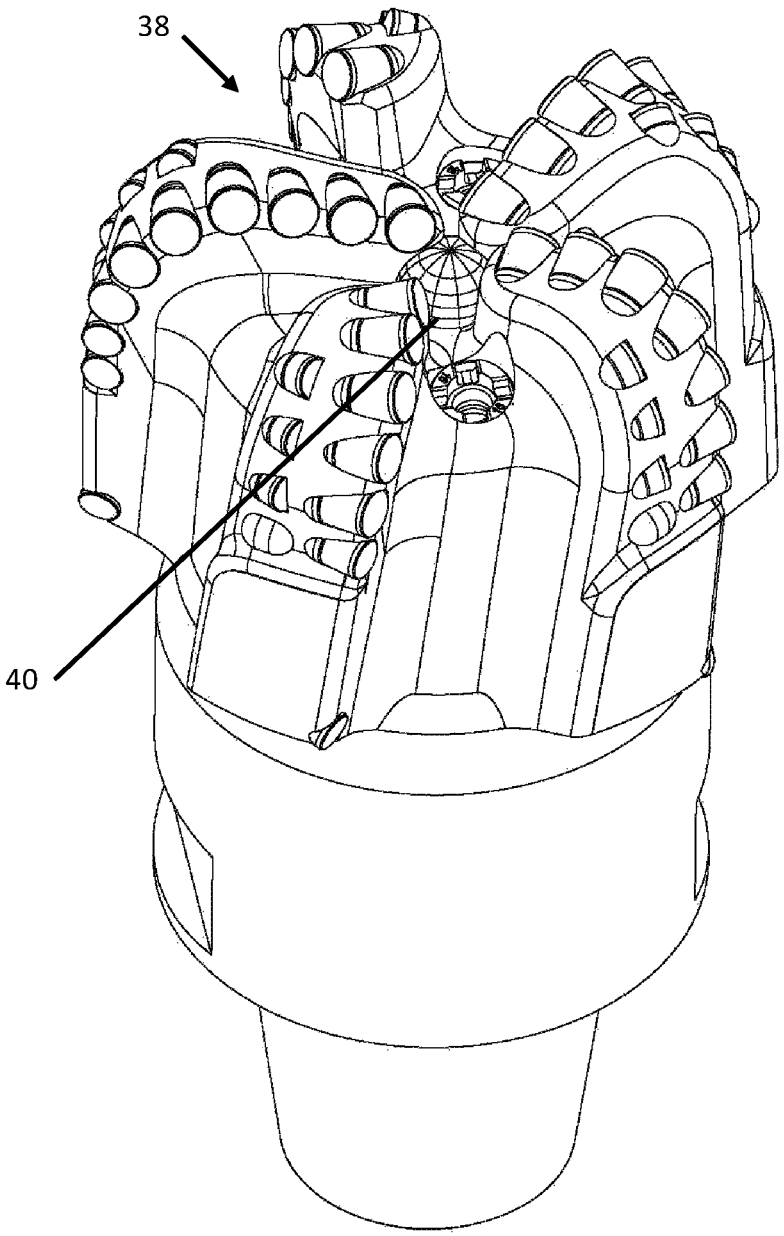
FIG. 4A is an oblique top view of a third preferred alternate embodiment of the present invention having a hemispherical projecting element.
Figure 4B:
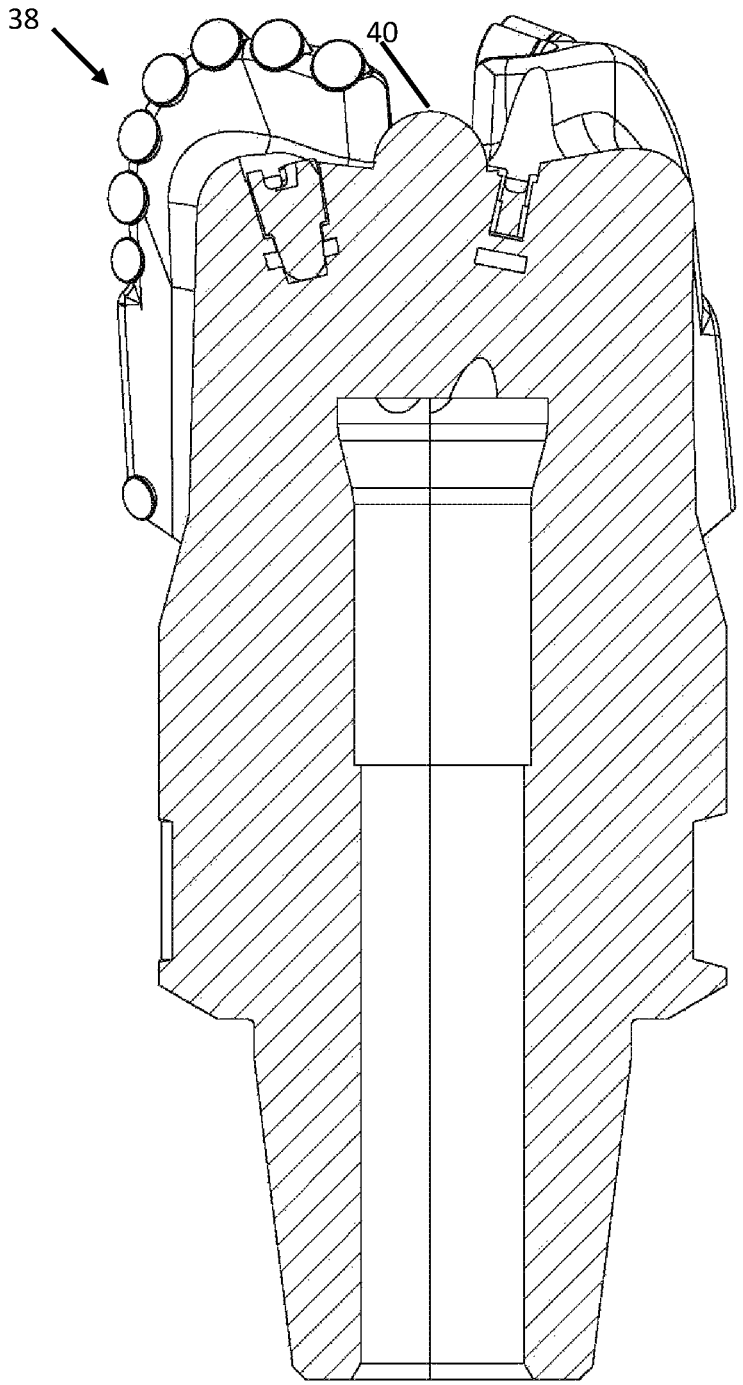
FIG. 4B is a cut-away side view of the third preferred alternate embodiment of the present invention of FIG. 4A.
Figure 4C:
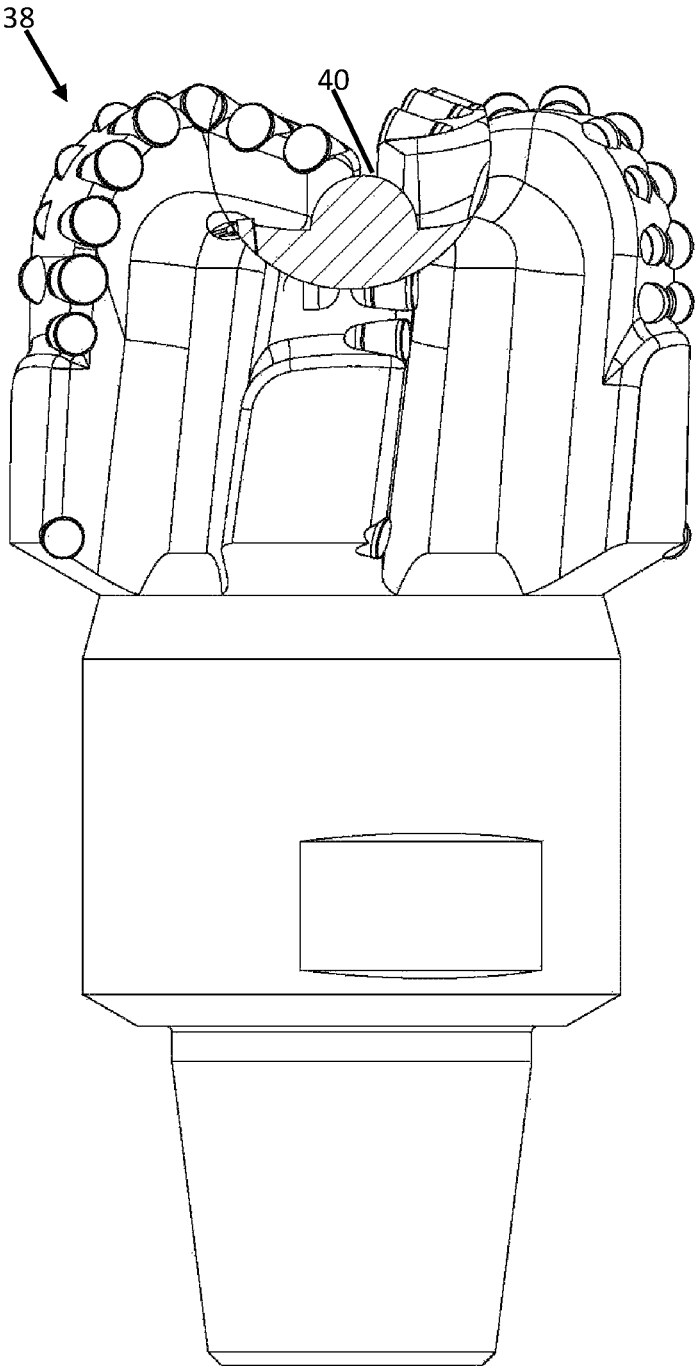
FIG. 4C is a partial detailed cut-away side view of the third preferred alternate embodiment of the present invention of FIG. 4A.

Referring now generally to the Figures and particularly to FIGS. 4A, 4B and 4C, a third preferred embodiment of the present invention 38 (hereinafter, "third invented bit" 34) is shown. The third invented bit 38 has elements 12-22 corresponding to those of the prior art bit 10. In addition, the third invented bit 38 comprises a hemispherical projecting element 40 positioned within the cone 24 of FIG. 1. The hemispherical projecting element 40 is shaped and sized and positioned to push debris away from cone 24 and toward the fluid flow emanating from jets 32. It not necessary that the hemispherical projecting element 40 have smooth sides, although a smooth sided hemispherical projecting element 40 is shown for illustrative purposes. Those of skill in the art will further recognize that the hemispherical projecting element 40 may be integrally formed as part of the body 12 of the third invented bit 38, or be otherwise attached thereto.

We claim:

1. A drill bit for use in drilling a wellbore, said drill bit comprising a body having a longitudinal axis, and the body forming an end, a plurality of blades and an internal projection, wherein said plurality of blades extend beyond said end and curve toward said longitudinal axis and each of said plurality of blades join with said internal projection, a plurality of cutters fixed to said blades, and said internal projection extending symmetrically along said longitudinal axis from said end, and said internal projection not extending beyond the plurality of blades.

2. The drill bit of claim 1, wherein said internal projection is lobe shaped.

3. The drill bit of claim 2, wherein said internal projection is hemispherical.

4. The drill bit of claim 1, wherein said internal projection is tapered.

* * * * *